US006272923B1

(12) United States Patent
Stephan

(10) Patent No.: US 6,272,923 B1
(45) Date of Patent: Aug. 14, 2001

(54) DETERMINING FILL LEVEL OF ENGINE COOLING SYSTEM

(75) Inventor: Waldemar Stephan, Dortmund (DE)

(73) Assignee: Pierburg Aktiengesellschaft, Neuss (DE)

( * ) Notice: Subject to any disclaimer, the term of this patent is extended or adjusted under 35 U.S.C. 154(b) by 0 days.

(21) Appl. No.: 09/396,111

(22) Filed: Sep. 14, 1999

(30) Foreign Application Priority Data

Sep. 15, 1998 (DE) ..... 198 42 167

(51) Int. Cl.[7] ..... G01F 23/00
(52) U.S. Cl. ..... 73/290 R
(58) Field of Search ..... 73/168, 290 R, 73/302; 137/386; 340/612, 618

(56) References Cited

U.S. PATENT DOCUMENTS

| | | | | |
|---|---|---|---|---|
| 3,763,836 | | 10/1973 | Guehr . | |
| 4,786,866 | * | 11/1988 | Yabe et al. | 324/158 MG |
| 4,913,625 | * | 4/1990 | Gerlowski | 417/18 |

FOREIGN PATENT DOCUMENTS

| | | |
|---|---|---|
| 7037473 | 2/1971 | (DE) . |
| 2131271 | 1/1972 | (DE) . |
| 3825500 | 2/1990 | (DE) . |
| 4116496 | 12/1991 | (DE) . |
| 42 121971 | 11/1992 | (DE) . |
| 0893582 | 1/1999 | (EP) . |
| 07026953 | 1/1995 | (JP) . |

* cited by examiner

*Primary Examiner*—Hezron Williams
*Assistant Examiner*—Willie Morris Worth
(74) *Attorney, Agent, or Firm*—Herbert Dubno; Andrew Wilford

(57) ABSTRACT

A cooling system of a motor-vehicle internal-combustion engine has a pump driven by a current-consuming electrical motor. The liquid fill level of a this system is determined by continuously and concurrently monitoring current consumption of the electrical motor and generating an output corresponding thereto. The output is continuously compared with at least one threshold and a difference between the output and the threshold is established as the fill level of the cooling system. An alarm signal is emitted when the output drops below the threshold. When the output is compared with two separate such thresholds one of which is lower than the other, the signal is emitted when the output drops below the lower threshold. It is also within the scope of this invention to emit the alarm signal when the output drops to a level somewhat above the threshold, the difference being determined electronically by the control system serving as comparator.

7 Claims, 2 Drawing Sheets

DETERMINING FILL LEVEL OF ENGINE COOLING SYSTEM

FIELD OF THE INVENTION

The present invention relates to a cooling system for an internal combustion system. More particularly this invention concerns a system for determining the fill level of such an engine cooling system.

BACKGROUND OF THE INVENTION

In a standard motor-vehicle cooling system sensors are provided for determining the fill level of the liquid. Such sensors can be of the simple float or pressure type and serve mainly to ascertain if the fill level dips below a certain threshold. This information is used to indicate to the driver that the coolant supply should be checked.

Such a system is invariably of the simple on/off type, that is it merely indicates whether or not the fill level is above or below a certain threshold. It gives no indication of how much above or below, that is does not provide an output of relative fill level. In addition the sensors of such systems are notoriously unreliable. Most work poorly in a sometimes violently moving bath of water containing various chemically active substances and have a short service life.

In another known system described in German patent document 41 16 496 a device detects overloading of the coolant pump and alters the timing or fuel feed of the engine so that it runs cooler. Thus this arrangement provides a sort of emergency operation mode, but in no way supplies the user of the engine with information about how much coolant is in the system.

OBJECTS OF THE INVENTION

It is therefore an object of the present invention to provide an improved system for determining the fill level of the liquid in a cooling system.

Another object is the provision of such an improved system for determining the fill level of the liquid in a cooling system which overcomes the above-given disadvantages, that is which supplies an output indicating relative fill level.

A further object is to provide an improved apparatus for doing this which is very simple and reliable and which can be incorporated at minimal cost into a motor vehicle.

SUMMARY OF THE INVENTION

A cooling system of a motor-vehicle internal-combustion engine has a pump driven by a current-consuming electrical motor. The liquid fill level of a this system is determined according to the invention by continuously and concurrently monitoring current consumption of the electrical motor and generating an output corresponding thereto. The output is continuously compared with at least one threshold and a difference between the output and the threshold is established as the fill level of the cooling system.

Monitoring the current consumption of the pump's motor is extremely easy and can be done at very little cost, it merely being necessary to set up an ammeter, that is a voltage meter measuring current drop across a resistor, in the line to the motor driving the water pump. The need for actual sensors in the cooling system is avoided, which means that the liquid level can be monitored more effectively with equipment that is simpler, cheaper, and more reliable. What is more the system is capable of determining the coolant level somewhat analogously, or at least at several different levels which is quite useful. The system is so simple and inexpensive that it can even be used for redundancy's sake in addition to the known system with a sensor in the reservoir and a simple warning lamp for low coolant.

In accordance with the invention an alarm signal is emitted when the output drops below the threshold. When the output is compared with two separate such thresholds one of which is lower than the other, the signal is emitted when the output drops below the lower threshold. It is also within the scope of this invention to emit the alarm signal when the output drops to a level somewhat above the threshold, the difference being determined electronically by the control system serving as comparator.

In practice it has been surprising learned that there are three distinct levels of current consumption for the electrical motor of a water pump in a cooling system. When the system is completely full and the pump is only moving liquid, the load is greatest and current consumption is at its maximum. When the level is somewhat low so that there is cavitation and the pump periodically is pushing gas in addition to liquid, the level is at an intermediate level. Finally when the system is dry the pump runs freely, moving no significant load, so that consumption it at a minimum. In fact the intermediate cavitation level is not represented by a sudden change but is a gradual change in current consumption, so the system can even gauge intermediate fill levels.

According to the invention the sensor can be incorporated in the motor. It can be an ammeter or hall-effect sensor.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
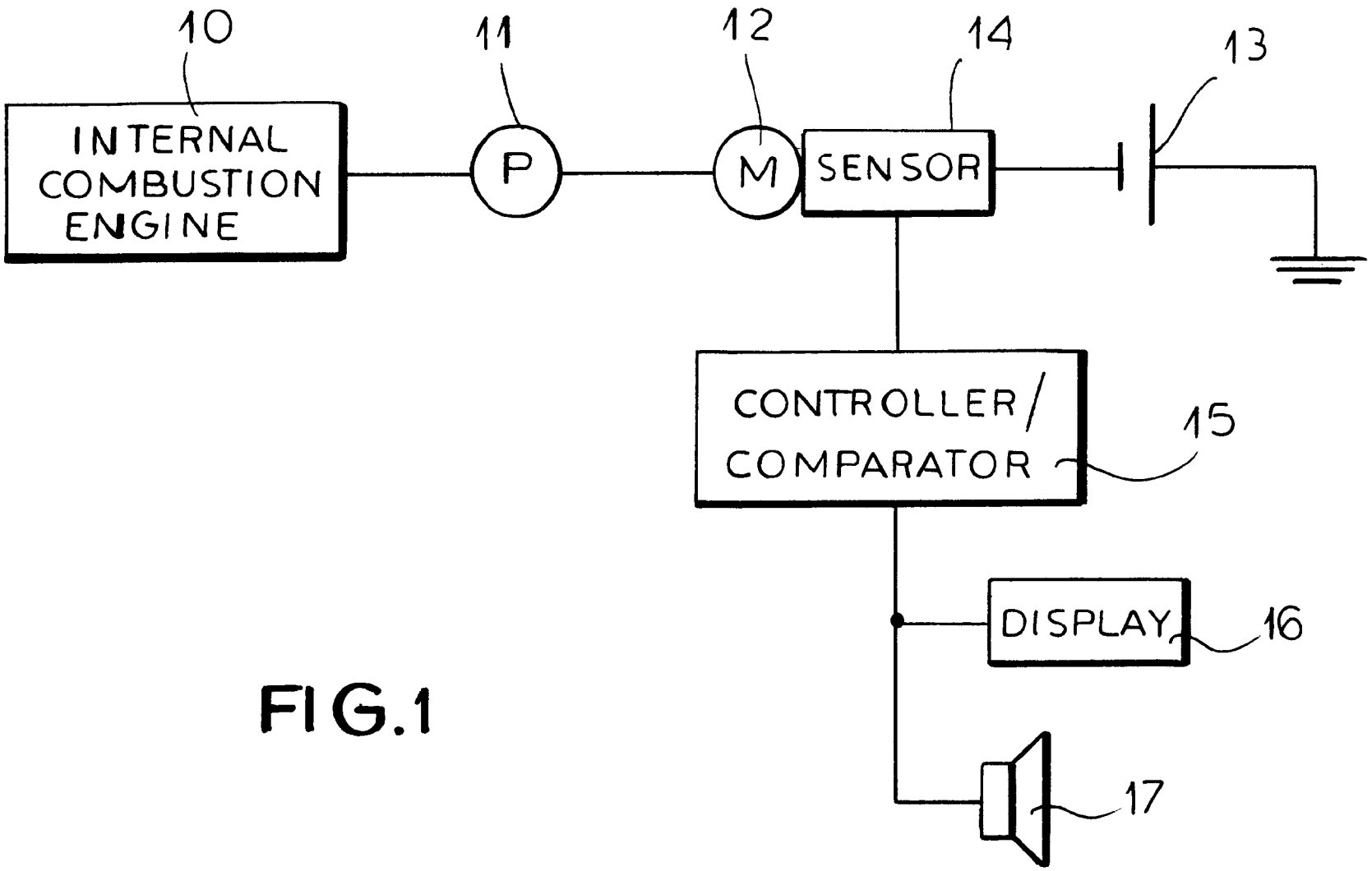
FIG. 1 is a graph illustrating the method of this invention.

As seen in FIG. 1 an internal combustion engine 10 has a cooling system including a coolant pump 11 powered by a standard d-c motor 12 from a motor-vehicle electric source, here a battery 13. A simple ammeter-type sensor 14 is provided between the power source 13 and the motor 12 to detect the power consumption of, that is the amperage flowing through, the motor 12. This output is fed as described below to a multilevel comparator 15 connected to a display 16 and alarm 17.

Figure 2:
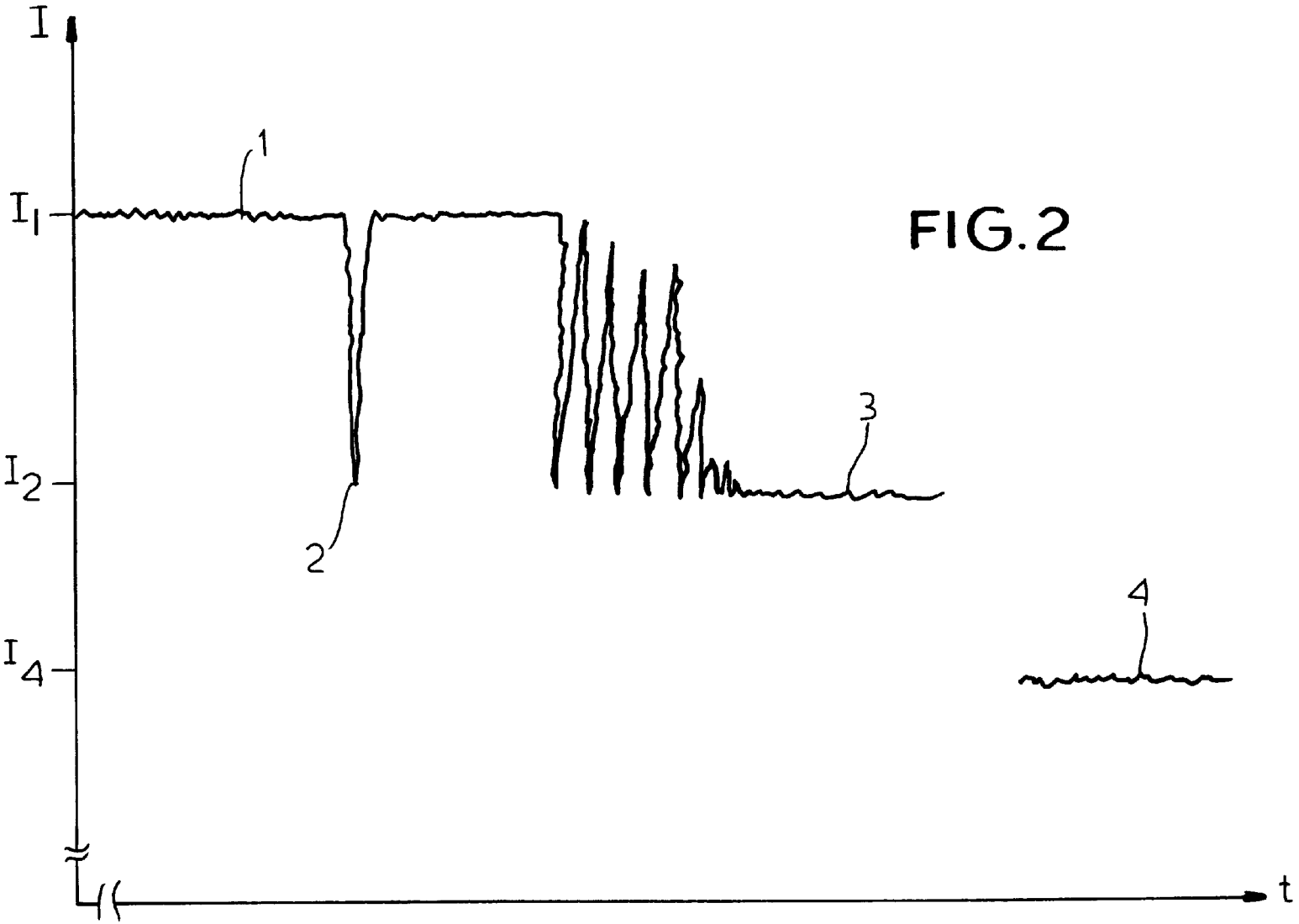
FIG. 2 is the system in accordance with the invention.

In FIG. 2 time t is plotted on the abscissa and the amount of current I consumed by the motor 12 is shown on the ordinate. During normal operation with a full coolant system the pump 11 will be operating against the load constituted by the mass of the liquid it is moving and will consume a relatively high level $I_1$ of current as shown by region 1 of the curve. If, however, there is momentary cavitation or the liquid level drops such that for an instant the pump 11 is not pushing any load, the current consumption will drop instantaneously as shown at 2 to a level $I_2$.

As the coolant-liquid drops such free-running of the pump 11 will become more and more frequent as shown by the curve portion 3 until it, drops steadily to and settles at the level $I_2$ indicating that the system is in full cavitation, moving little liquid. Finally if the liquid runs out altogether so the pump 11 is spinning dry, the current consumption is at the very low level $I_4$. During the period before the level drops to $I_4$, the comparator can average the output to determine a relative level of the coolant, here water, in the system.

Thus the display 16 can show the relative level of liquid in the cooling system and the alarm 17, which can be a buzzer or warning lamp, will be activated, if the level slips, below a predetermined threshold. In fact a multilevel warning can be provided, for instance a yellow lamp when the liquid level is above the danger level but in need of attention, and a red lamp when the danger level is reached. Only the lower threshold need actually be used with the comparator 15 calculating a position above it for the intermediate yellow-lamp warning.

I claim:

1. A method of determining the liquid fill level of a cooling system of a motor-vehicle internal-combustion engine where the cooling system has a pump driven by a current-consuming electrical motor, the method comprising the steps of continuously and concurrently:

monitoring current consumption of the electrical motor and generating an output corresponding thereto; and comparing the output with at least one threshold and establishing a difference between the output and the threshold as the fill level of the cooling system.

2. The method defined in claim 1, further comprising emitting an alarm signal when the output drops below the threshold.

3. The method defined in claim 2 wherein the output is compared with two separate such thresholds one of which is lower than the other, the signal being emitted when the output drops below the lower threshold.

4. The method defined in claim 1, further comprising the step of emitting an alarm signal when the output drops to a level somewhat above the threshold.

5. In a cooling system for a motor-vehicle internal-combustion engine wherein the cooling system has a pump driven by a current-consuming electrical motor, sensor means for monitoring current consumption of the electrical motor and generating an output corresponding thereto; and control means for comparing the output with at least one threshold and establishing a difference between the output and the threshold as the fill level of the cooling system.

6. The combination defined in claim 5 wherein the sensor means is incorporated in the motor.

7. The combination defined in claim 5 wherein the sensor means is an ammeter.

* * * * *